US010974748B1

(12) United States Patent
Angel et al.

(10) Patent No.: US 10,974,748 B1
(45) Date of Patent: Apr. 13, 2021

(54) VEHICLE ADVISORY SYSTEM

(71) Applicant: Westinghouse Air Brake Technologies Corporation, Wilmerding, PA (US)

(72) Inventors: Kevin Angel, Marion, IA (US); Ann Grimm, Cedar Rapids, IA (US)

(73) Assignee: WESTINGHOUSE AIR BRAKE TECHNOLOGIES CORPORATION, Wilmerding, PA (US)

( * ) Notice: Subject to any disclaimer, the term of this patent is extended or adjusted under 35 U.S.C. 154(b) by 0 days.

(21) Appl. No.: 16/724,434

(22) Filed: Dec. 23, 2019

(51) Int. Cl.
*B61L 29/32* (2006.01)
*B61L 29/24* (2006.01)
*B61L 25/02* (2006.01)

(52) U.S. Cl.
CPC ..... *B61L 29/32* (2013.01); *B61L 25/025* (2013.01); *B61L 29/243* (2013.01)

(58) Field of Classification Search
CPC ..... B61L 29/32; B61L 25/025; B61L 29/243
USPC ..... 340/988
See application file for complete search history.

(56) References Cited

U.S. PATENT DOCUMENTS 3,514,622 A * 5/1970 Costa ..... G08B 3/10 307/10.1
5,699,986 A * 12/1997 Welk ..... B61L 29/24 246/122 R
6,609,049 B1 * 8/2003 Kane ..... B61L 25/021 246/124
7,398,140 B2 7/2008 Kernwein
8,478,463 B2 7/2013 Grimm
8,998,148 B2 * 4/2015 Parida ..... B61L 23/00 246/111
9,168,936 B2 10/2015 Grimm
2004/0015276 A1 1/2004 Kane
2009/0115633 A1 * 5/2009 Lawry ..... B61L 29/32 340/936

OTHER PUBLICATIONS

Union Pacific "Federal Railroad Administration's Train Horn & Quiet Zone Rule" Dec. 1, 2019; 3 pages.

* cited by examiner

*Primary Examiner* — John A Tweel, Jr.
(74) *Attorney, Agent, or Firm* — Christopher R. Carroll; The Small Patent Law Group LLC

(57) ABSTRACT

A vehicle advisory system and method determine whether a vehicle system moving along a route is within a designated distance of a feature of interest, initiate a distance-based alert sequence of an advisory device of the vehicle system in response to determining that the vehicle system is at or within the designated distance of the feature of interest, and generate advisory signals using the advisory device according to the distance-based alert sequence. The advisory signals are indicative of passage of the vehicle system by the feature of interest during the distance-based alert sequence. The distance-based alert sequence dictates one or more of plural different commencement locations or commencement distances at which advisory signals are generated by the advisory device. The distance-based alert sequence also dictates one or more of plural different termination locations or termination distances where generation of the advisory signals by the advisory device is terminated.

21 Claims, 3 Drawing Sheets

VEHICLE ADVISORY SYSTEM

BACKGROUND

Technical Field

The subject matter described herein relates to systems and methods that generate advisory signals to inform of the movement of vehicle systems.

Discussion of Art

Some vehicle systems include horns or other devices that generate sounds to inform others of the movement of the vehicle systems. For example, rail vehicle systems may include horns that are activated to generate sound to warn others in the vicinity of a crossing that the vehicle system is approaching the crossing. The horns may be repeatedly activated to increase the likelihood that persons, other vehicles, etc. near the crossing are aware of the approaching rail vehicle system. The known activation sequence of the horn is a time-based sequence. For example, the Federal Railroad Administration may require trains to sound horns for fifteen to twenty seconds before entering a public grade crossing but not more than one quarter mile before the crossing.

Some of these horns are controlled manually while others are automatically controlled. The manually controlled horns are subject to operator error, while the automatic activation of horns may be subject to errors caused by changes in speed. For example, activation of the horn for the required time period (e.g., fifteen to twenty seconds) may be activated one quarter mile from a crossing. But, due to the rail vehicle speeding up, the activation sequence of the horn may not be complete before the rail vehicle enters the crossing. This may result in others near the crossing not hearing the horn in time to avoid a collision. As another example, due to the rail vehicle slowing down, the activation sequence of the horn may be complete well before the rail vehicle enters the crossing. This may result in others near the crossing erroneously believing it is safe to enter the crossing while the rail vehicle has not yet reached the crossing.

BRIEF DESCRIPTION

In one embodiment, a method includes determining whether a vehicle system moving along a route is within a designated distance of a feature of interest in or along the route, initiating a distance-based alert sequence of an advisory device of the vehicle system in response to determining that the vehicle system is at or within the designated distance of the feature of interest, and generating advisory signals using the advisory device according to the distance-based alert sequence. The advisory signals are indicative of passage of the vehicle system by the feature of interest during the distance-based alert sequence. The distance-based alert sequence dictates one or more of plural different commencement locations or commencement distances at which advisory signals are generated by the advisory device. The distance-based alert sequence also dictates one or more of plural different termination locations or termination distances where generation of the advisory signals by the advisory device is terminated.

In one embodiment, a system includes a controller configured to determine whether a vehicle system moving along a route is within a designated distance of a feature of interest in or along the route. The controller is configured to initiate a distance-based alert sequence of an advisory device of the vehicle system in response to determining that the vehicle system is at or within the designated distance of the feature of interest. The controller is configured to direct the advisory device to generate advisory signals according to the distance-based alert sequence. The advisory signals are indicative of passage of the vehicle system by the feature of interest during the distance-based alert sequence. The advisory signals are generated by the advisory device at different distances of the vehicle system from the feature of interest that are dictated by the distance-based alert sequence.

In one embodiment, a system includes a location determining device configured to determine vehicle locations of a vehicle system as the vehicle system moves along one or more routes, a memory configured to store feature locations of features of interest in or along the one or more routes, an advisory device configured to generate advisory signals to notify of passage of the vehicle system through or by the features of interest, and a controller configured to monitor the vehicle locations and determine when the vehicle system is within a designated distance of one or more of the features of interests. The controller is configured to initiate a distance-based alert sequence of the advisory device of the vehicle system in response to determining that the vehicle system is at or within the designated distance of one or more of the features of interest. The advisory signals are generated by the advisory device as a spatial function of one or more of (a) distance of the vehicle system from one or more of the features of interest or (b) the locations of the vehicle system in the distance-based alert sequence.

BRIEF DESCRIPTION OF THE DRAWINGS

The inventive subject matter may be understood from reading the following description of non-limiting embodiments, with reference to the attached drawings, wherein below.

DETAILED DESCRIPTION

Figure 1:
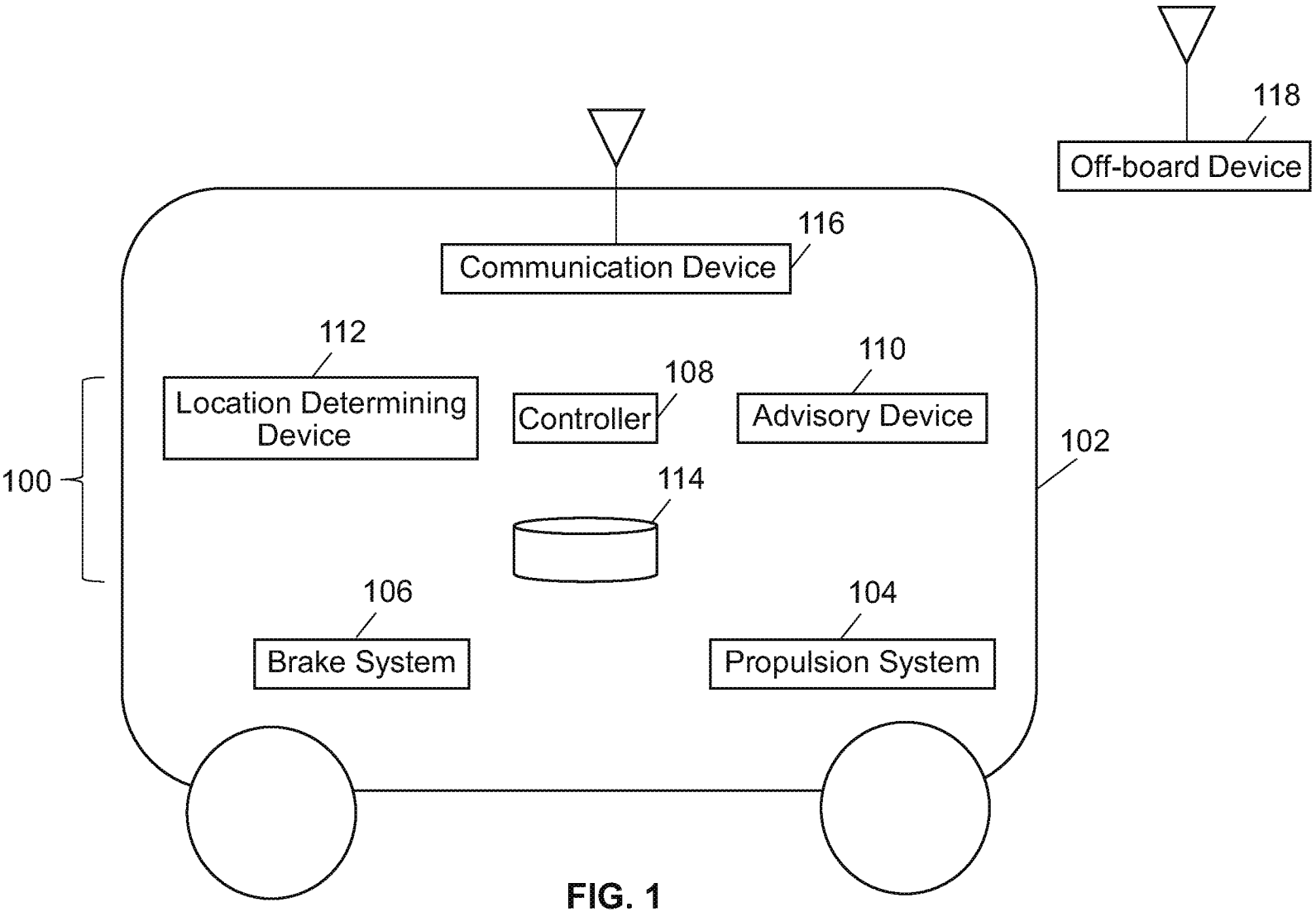
FIG. 1 illustrates one example of a vehicle advisory system.

Embodiments of the inventive subject matter described herein relate to vehicle advisory systems and methods that use a distance-based sequence to activate an advisory device of a vehicle system to warn off-board systems and/or persons of the approach of the vehicle system to a feature of interest. These systems and methods can be used to activate a horn, light, or the like, to notify others that the vehicle system is approaching a feature of interest. Examples of such a feature include a crossing or intersection between routes, a location where people or other vehicle systems are known to be located, an area with increased population density, a signal, a wayside device (e.g., a sensor), or the like. The distance-based alert sequence can involve the advisory device being activated and deactivated as a spatial function of distance of a vehicle system to the feature of interest as the vehicle of interest approaches the feature of interest. For example, the distance-based sequence can dictate or designate plural different distances from a designated location and/or can dictate or designate plural different locations where an advisory signal is to begin to be generated and can dictate or designated plural different locations or distances where generation of the advisory signal is terminated. The sequence optionally can be referred to as a location-based sequence. The locations or distances in this sequence where the advisory signals are to begin to be generated can be referred to as commencement or beginning locations or distances. The locations or distances in this sequence where generation of the advisory signals is terminated can be referred to as termination or ending locations or distances (even though not all of these locations or distance is the end or termination of the sequence). This alert sequence differs from a time-based sequence that activates or deactivates an advisory device as a function of time to arrival at the feature of interest.

The systems and methods can determine when the vehicle system is at or within (e.g., no farther than) a designated distance to the feature of interest. The systems and methods can determine an activation sequence for the advisory device as percentages or other fractions of the designated distance.

As one example, the systems and methods can determine different ranges of distances from the feature of interest for activating and deactivating the advisory device. The advisory device is activated (e.g., to generate sound, to generate light, to communicate a signal, etc.) while the vehicle system or a designated portion of the vehicle system is within an activation range of distances in the sequence. The advisory device is deactivated (e.g., to stop generating sound, to stop generating light, to stop communicating a signal, etc.) while the vehicle system or the designated portion of the vehicle system is within a deactivation range of distances in the sequence. The sequence can alternate between activation ranges and deactivations such that the advisory device alternates between generating the advisory signal and not generating the advisory signal based on the changing distance between the vehicle system and the feature of interest.

The sequence can include the advisory signal being generated a designated number of times at the different distances. For example, a horn can be sounded for two longer time periods (e.g., two longer horn blasts) followed by two shorter time periods (e.g., two shorter blasts). This sequence may be required to be completed (e.g., by rules, regulations, laws, or the like) prior to a leading end of the vehicle system passing the feature of interest. For example, the distance-based alert sequence may dictate that the horn is sounded the designated number of times for the designated time periods before a leading end of the vehicle system reaches the far side of a crossing between routes.

FIG. 1 illustrates one example of a vehicle advisory system 100. The vehicle advisory system can be entirely or at least partially disposed onboard a vehicle system 102. The vehicle system may be a single vehicle system formed from a single vehicle, or be a multi-vehicle system formed from two or more vehicles. With respect to the multi-vehicle system, the vehicle system may be formed from two or more vehicles that are mechanically coupled with each other to travel together as a group along one or more routes. Optionally, the multi-vehicle system may be formed from two or more vehicles that are not mechanically coupled with each other, but are logically coupled with each other. For example, these vehicles may communicate with each other to coordinate the movements of the vehicles so that the vehicles travel together as the vehicle system (for example, as a convoy).

The vehicle or vehicles forming the vehicle system may be rail vehicles, such as locomotives, railcars, rail transit vehicles, or the like. Optionally, the vehicle system may be formed from one or more automobiles, trucks, buses, mining vehicles, agricultural vehicles, marine vessels, aircraft (manned or unmanned), or the like, in alternate embodiments. While the description herein may be provided in terms of a rail vehicle system, not all embodiments of the inventive subject matter described herein are limited to rail vehicles.

The advisory system includes a controller 108 that may be located onboard the vehicle system. The controller represents hardware circuitry that includes and/or is connected with one or more processors (for example, one or more integrated circuits, one or more field programmable gate arrays, one or more microprocessors, one or more microcontrollers, or the like). The controller performs operations of the advisory system as described herein.

The controller communicates with an advisory device 110 to control when the advisory device generates one or more advisory signals. As one example, the advisory device can represent a horn that generates audible sounds as the advisory signals. The controller can direct the advisory device to generate the sounds at defined distances from a feature of interest in or along a route and can direct the advisory device when to not generate the sounds. As another example, the advisory device may represent or may include one or more light-generating devices. For example, the controller can direct the advisory device when to activate to generate light and when the advisory device does not generate light. As another example, the advisory device can represent hardware circuitry that includes and/or is connected with one or more processors for generating or directing a communication device 116 to generate wireless signals. These wireless signals may be communicated to one or more off-board devices 118. For example, the wireless signals may be communicated to the off-board device that can be held or with a person, disposed onboard another vehicle or vehicle system, may be a warning device disposed along the route, or the like. The wireless signal can inform the off-board device of the approaching vehicle system 102 to the feature of interest in or along the route. Examples of the off-board device can include a mobile phone, a communication device disposed onboard another vehicle, a wayside device, a light signal, a gate at a crossing, or the like.

The communication device 116 represents transceiver circuitry that includes and/or represents one or more antennas, modems, or the like. The communication device can be used to wirelessly communicate with devices or systems that are off-board the vehicle system 102. For example, the communication device can include or represent a radio, cellular communication device, or the like.

The controller can receive output from a location determining device 112 to determine where the vehicle system 102 is located. The location determining device can represent a global positioning system receiver, a dead reckoning system, a wireless triangulation device, etc. Optionally, the location determining device can represent an optical sensor, such as a camera, that outputs images and/or videos that are examined by the controller to determine the location of the vehicle system 102. The controller can examine the output provided by the location determining device to determine where the vehicle system 102 is located along one or more routes. In one embodiment, the controller determines where a designated portion of the vehicle system 102 is located based on the output from the location determining device. For example, the controller can determine where the leading end or leading edge of the vehicle system is located along a direction of travel based on output from the location determining device. Alternatively, the controller can determine where another portion of the vehicle system is located based on output from the location determining device.

The controller can access one or more tangible and non-transitory computer-readable storage media, such as one or more computer memories 114. The memory 114 shown in FIG. 1 can represent one or more computer hard drives, servers, optical discs, removable disks, or the like. The memory can store locations of features of interest along one or more routes. These features of interest can include, for example, a crossing or intersection between routes, a location of a gate along the route, the location of a signal along a route, the location of an area of increased population density (for example, an urban area), or the location of another area or place where an advisory signal is needed toward others of the approaching vehicle system.

The vehicle system can include a propulsion system 104 and/or a brake system 106 to control movement of the vehicle system. For example, the vehicle system 102 can include one or more engines, motors, or the like, in the propulsion system that generates tractive effort or propulsion to move the vehicle system along one or more routes. The brake system can represent one or more friction brakes, air brakes, regenerative brakes, or the like. The brake system operates to slow or stop movement of the vehicle system 102.

In operation, the controller determines whether the vehicle system is at or within a designated distance to a target location associated with a feature of interest in or along a route being traveled by the vehicle system. The controller can make this determination based on output from the location determining device, as described above. This target location can be a closest edge or point of the feature of interest to the vehicle system. Alternatively, the target location can be a farthest edge or point of the feature of interest from the vehicle system. Alternatively, the target location can be another edge or point of the feature of interest.

Once the controller determines that the vehicle system is at or within the designated distance of the feature of interest, the controller can determine and/or initiate a distance-based alert sequence of the advisory device. For example, the controller can create the distance-based alert sequence responsive to determining that the vehicle system is at or within the designated distance of the feature of interest, or the controller can obtain the distance-based alert sequence from the memory 114. The controller can then direct the advisory device when to generate advisory signals according to the distance-based alert sequence. These advisory signals can indicate approach of the vehicle system to the feature of interest. The distance-based alert sequence is used to control the advisory device to generate advisory signals at different distances of the vehicle system from the feature of interest, regardless of the speed or changes in speed of the vehicle system.

For example, the distance-based alert sequence can be used by the controller to direct the advisory device to generate advisory signals as a function of distances of the vehicle system from the feature of interest. The alert sequence can direct the advisory signals to be generated while the vehicle system or portion of the vehicle system is within one or more ranges of distances from the feature of interest and can direct advisory signals to not be generated while the vehicle system or portion of the vehicle system is with one or more other ranges of distances from the feature of interest.

Figure 2:
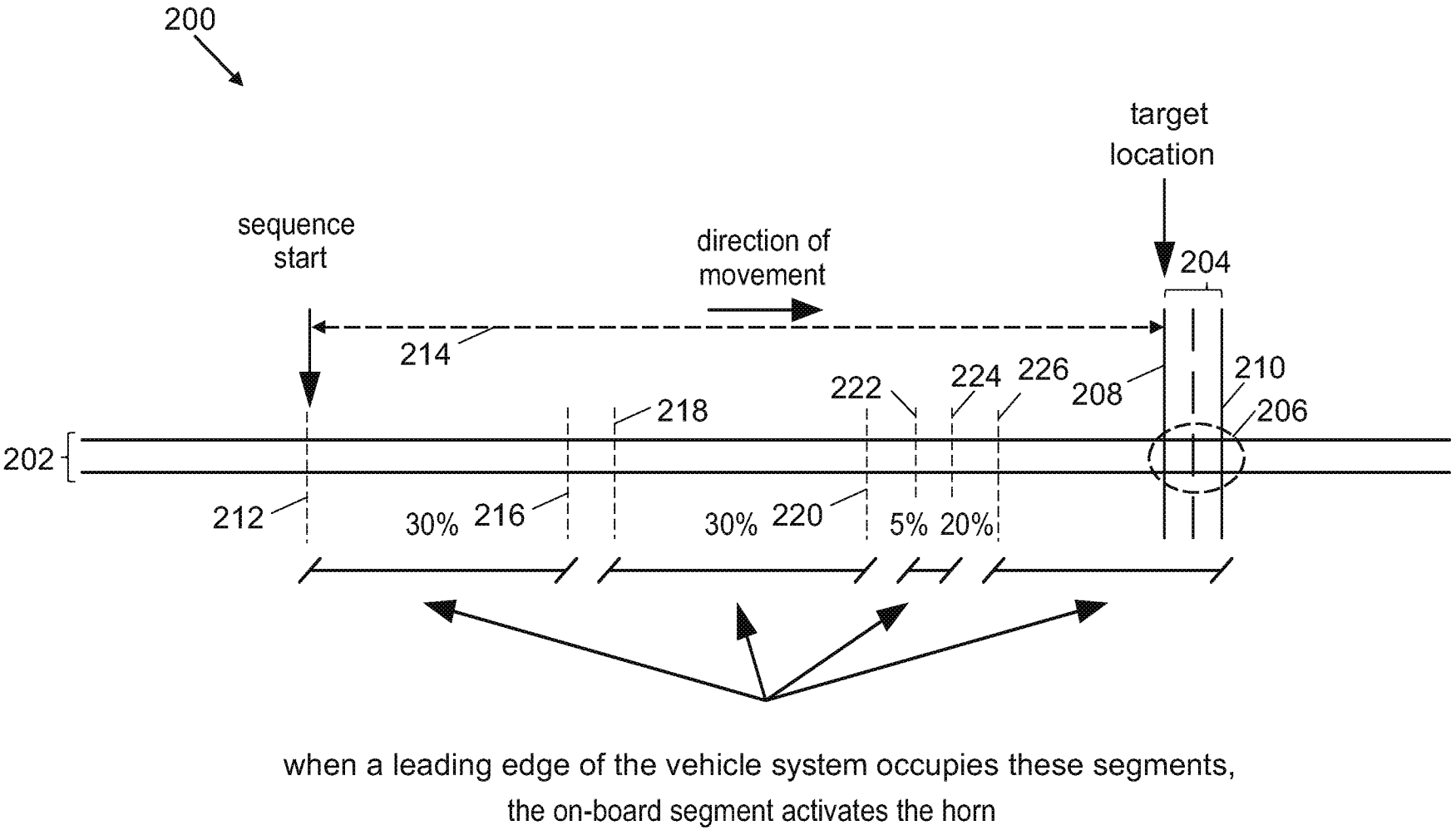
FIG. 2 illustrates one example of a distance-based alert sequence.
Figure 3:
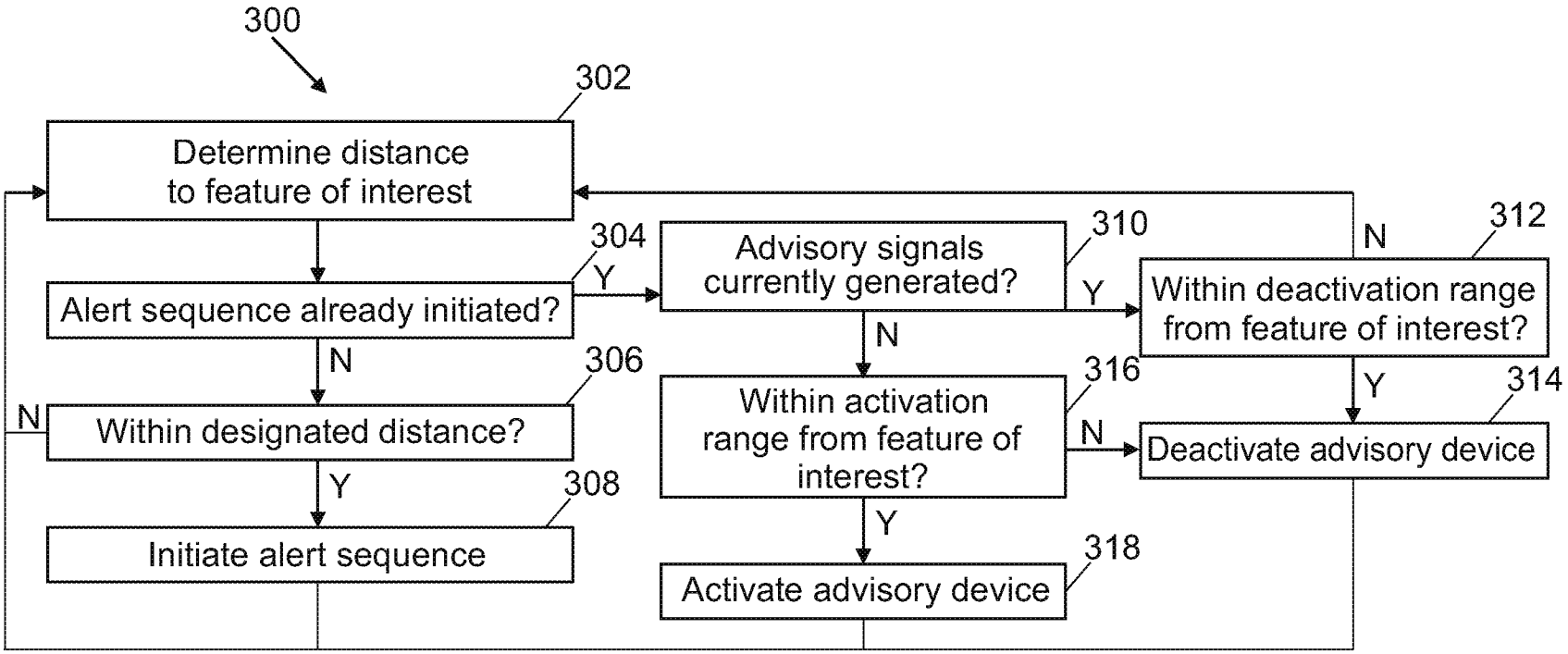
FIG. 3 illustrates a flowchart of one example of a method for providing a distance-based alert sequence.

FIG. 2 illustrates one example of a distance-based alert sequence 200. FIG. 3 illustrates a flowchart of one example of a method 300 for providing a distance-based alert sequence. While some examples of different distances or functions of distance are provided herein to describe the distance-based alert sequence, other distances or functions of distance may be used. The examples of distances in which to generate the advisory signals described herein are not limiting on all embodiments of the inventive subject matter.

As shown in FIG. 2, a first route 202 intersects with a second route 204 at an intersection or crossing 206. The first route can represent a track on which a rail vehicle system travels. The second route can represent another type of route, such as a road on which one or more automobiles, trucks, buses, or the like travel. Alternatively, each of the route 202 and/or 204 can represent a track, road, path, waterway, or the like. The vehicle system shown in FIG. 1 can be approaching the second route along the first route in the direction of movement shown in FIG. 2.

With respect to the method 300 shown in FIG. 3, at 302 a distance of the vehicle system to a target location associated with a feature of interest is determined. The controller can determine the distance of a leading-edge of the vehicle system to the crossing 206 as the feature of interest. The location of the feature of interest can be stored in the memory 114 shown in FIG. 1, as described above. For example, a target location 208, such as the edge of the second route that will first be encountered by the vehicle system, can be used by the controller to determine the distance of the leading edge of the vehicle system to the crossing 206. Alternatively, another target location can be used, such as a midpoint of the second route 204, a trailing edge 210 of the second route 204 (for example, the farther or farthest or opposite edge of the second route relative to the direction of movement of the vehicle system), or the like.

At 304, a determination is made as to whether the distance-based alert sequence has already been initiated. In this example, the vehicle system has not yet reached the designated distance to the feature of interest (e.g., the crossing 206). Therefore, the distance-based alert sequence has not yet been initiated. As a result, flow of the method 300 can proceed toward 306.

At 306, a determination is made as to whether the vehicle system is at or within a designated distance to the feature of interest. For example, the controller can determine whether the leading edge of the vehicle system is at a sequence start or sequence initiation location 212. The start or initiation location 212 may be identified by the controller as being the designated distance 214 from the target location 208. If the vehicle system has not yet reached the start or initiation location 212 that is the designated distance 214 from the target location 208, flow of the method 300 can return toward 302. In this way, one embodiment of the method 300 can proceed in a loop-wise manner until the vehicle system is at or within the designated distance from the feature of interest.

Returning to the discussion of the determination made at 306 in the method 300, if the vehicle system is at or within the designated distance to the feature of interest, flow of the method 300 can proceed toward 308. For example, responsive to the controller determining that the leading edge of the vehicle system is at or has passed the start or initiation location 212 along the route 202, the controller can initiate the distance-based alert sequence. The distance-based alert sequence can be initiated at 308 by activating the advisory device 110 shown in FIG. 1. Activation of the advisory device can involve the advisory device generating one or more audible sounds, generating light, sending wireless signals, or the like. Once the distance-based alert sequence is initiated, flow of the method 300 can return back toward 302.

The distance-based alert sequence can dictate different fractions or percentages of distances from the feature of interest during which the advisory signals are generated. The distance-based alert sequence also can dictate other fractions or percentages of distances from the feature of interest during which the advisory signals are not generated. In the example illustrated in FIG. 2, the function of distances dictated by the distance-based alert sequence involves the advisory signals being generated for the first 30% of the designated distance to the feature of interest. The advisory signals are generated while the vehicle system or leading-edge of the vehicle system is within this first 30% of the designated distance to the feature of interest. For example, the advisory signals may be generated while the leading edge of the vehicle system is from 70% to 100% of the total designated distance to the feature of interest.

The advisory signals are then not generated over the next 5% of the designated distance to the feature of interest. For example, following the first 30% of the designated distance to the feature of interest, the advisory signals may not be generated for the next 5% of the designated distance to the feature of interest. The alert sequence can then direct the advisory signals to be generated over the next 30% of the designated distance to the feature of interest, then direct advisory signals to not be generated over the next 5% of the designated distance to the feature of interest. The alert sequence can include the advisory signals being generated again over the next 5% of the designated distance to the feature of interest, and then the advisory signals are not generated over the following 5% of the designated distance toward the feature of interest. The alert sequence may conclude by directing the advisory signals to be generated for a remaining distance, such as the final 20% of the designated distance 214 from the start or initiation location 212 to the far edge 210 of the route 204.

Returning to the description of the method 300 shown in FIG. 3, after initiation of the alert sequence (for example, at the location 212), flow of the method 300 returns to 302. At 302, the distance to the feature of interest continues to be monitored and the advisory signals continue to be generated by the advisory device as the vehicle system moves toward the feature of interest. At 304, the determination is made as to whether the alert sequence has already been initiated. In this example, the alert sequence has been initiated because the vehicle system has passed the start or initiation location 212. As a result, flow of the method 300 proceeds toward 310.

At 310, a determination is made as to whether the advisory signals are currently being generated. In this example, the vehicle system is within the first range of distances of the distance-based alert sequence, such as between the start or initiation location 212 and an end location 216 of this first range. The distance from the start or initiation location 212 of the first range in the end location 216 of the first range can be a fraction or percentage of the designated distance 214 from the start or initiation location 212 to the feature of interest. For example, the distance from the start location 212 and the end location 216 can be 30% or another fractional percentage of the designated distance 214.

While the vehicle system is located within this first range of distances from the location 212 to the location 216, the controller directs the advisory device to continue generating advisory signals. As a result, flow of the method 300 proceeds from 310 toward 312. At 312, a determination is made as to whether or not the vehicle system is within a deactivation range from the feature of interest. The distance-based alert sequence can include one or more deactivation ranges of distances in which the advisory device does not generate the advisory signals. As the vehicle system has not yet reached a deactivation range in this example, flow of the method 300 can return back to 302.

The vehicle system continues moving along the route 202 toward the crossing 206 and through the first range of distances from the location 212 to the location 216. In the method 300, at 302, the current distance of the vehicle system to the feature of interest is determined. At 304, a determination is made as to whether the alert sequence has been initiated. In this example, because the vehicle system has already passed the start or initiation location 212 the alert sequence has been initiated. As a result, flow of the method 300 proceeds toward 310.

At 310, the advisory signals are determined as currently being generated. As a result, flow of the method 300 proceeds toward 312. Once the vehicle system or leading-edge of the vehicle system reaches the end location 216 of the first range of distances, at 312, the vehicle system is determined as reaching the deactivation range from the feature of interest. For example, the controller determines that the leading edge of the vehicle system has reached or passed the location 216. This location 216 can represent the end location of the first range of distances in which the advisory signals are generated and can represent the start location of a deactivation range or the advisory signals are not generated. Because it is determined that the vehicle system has reached this deactivation range, flow of the method 300 can proceed toward 314 from 312.

At 314, the advisory device is deactivated. For example, the controller can direct the advisory device to stop generating sounds, lights, or wireless signals. The advisory device may remain powered or otherwise turned on, but may stop generating sound, lights or wireless signals. Flow of the method 300 can return back toward 302 from 314.

As the vehicle system moves through the deactivation range of distances from the location 216 to a subsequent location 218, the advisory device may not generate advisory signals. Flow of the method 300 can proceed along the operations described in connection with 302, 304, and 310. At 310, it is determined that the advisory signals are not currently being generated while the vehicle system is at distances between the location 216 and the location 218. As a result, flow of the method 300 can proceed from 310 toward 316.

At 316, a determination is made as to whether the vehicle system is within an activation range from the feature of interest. While the vehicle system is between the locations 216 and 218, the controller can determine that the vehicle system is not within the activation range. As a result, flow of the method 300 can proceed from 316 toward 314. At 314, the advisory device remains deactivated and/or advisory signals continue to no longer be generated. Flow of the method 300 can then return toward 302 from 314.

Once the vehicle system reaches the location 218, the controller may determine (at 316) that the vehicle system is within an activation range from the feature of interest. For example, once the leading edge of the vehicle system reaches the location 218, the controller can determine the vehicle system is within an activation range and that the advisory signals are to be generated again. As a result, flow of the method 300 can proceed from 316 toward 318. At 318, the advisory device is activated to generate the advisory signals. For example, the advisory device may be turned on, or the advisory device that is already on may be directed to begin generating advisory signals again. Flow of the method 300 can then return back toward 302 from 318.

Flow of the method 300 can proceed through one or more of these operational loops as the distance from the vehicle system to the feature of interest changes. For example, while the leading edge of the vehicle system is within the first range of distances from the location 212 to the location 216, the advisory signals may continue to be generated. While the leading edge of the vehicle system is within the second range of distances from the location 216 to the location 218, the advisory signals may not be generated. While the leading edge of the vehicle system is within the third range of distances from the location 218 to the location 220 the advisory signals may continue to be generated. While the leading edge of the vehicle system is within a fourth range of distances from the location 220 to location 222, the advisory signals may not be generated. While the leading edge of the vehicle system is within a fifth range of distances from the location 222 to a location 224, the advisory signals may be generated.

While the leading edge of the vehicle system is within a sixth range of distances from the location 224 to a location 226, the advisory signals may no longer be generated. Finally, while the leading edge of the vehicle system is within a seventh range of distances extending from the location 226 to the opposite edge 210 of the second route 204, the advisory signals may continue to be generated.

The distance-based alert sequence can be used to ensure that advisory signals are generated over one or multiple different ranges of distances from the feature of interest, regardless of how fast the vehicle system moves, how slowly vehicle system moves, or how the speed of the vehicle system changes as the vehicle system moves toward the feature of interest. This can ensure that the alert sequence is performed and completed entirely before the vehicle system or the leading edge of the vehicle system completes passage through the feature of interest.

In one embodiment, a method includes determining whether a vehicle system moving along a route is within a designated distance of a feature of interest in or along the route, initiating a distance-based alert sequence of an advisory device of the vehicle system in response to determining that the vehicle system is at or within the designated distance of the feature of interest, and generating advisory signals using the advisory device according to the distance-based alert sequence. The advisory signals are indicative of passage of the vehicle system by the feature of interest during the distance-based alert sequence. The distance-based alert sequence dictates one or more of plural different commencement locations or commencement distances at which advisory signals are generated by the advisory device. The distance-based alert sequence also dictates one or more of plural different termination locations or termination distances where generation of the advisory signals by the advisory device is terminated.

Optionally, the advisory signals are generated and terminated as a function of distances of the vehicle system from the feature of interest in the distance-based alert sequence.

Optionally, the advisory signals are generated and terminated according to the distance-based alert sequence such that the advisory signals are generated at different distances from the feature-of-interest regardless of changes in speed of the vehicle system approaching the feature of interest.

Optionally, the advisory signals are generated at one or more first distances dictated by the distance-based alert sequence and the advisory signals are not generated at one or more second distances by the distance-based alert sequence.

Optionally, the distance-based alert sequence directs the advisory signals to be generated at different distances as one or more designated portions of the designated distance to the feature of interest.

Optionally, generating the advisory signals includes activating an audible device at different distances dictated by the distance-based alert sequence.

Optionally, generating the advisory signals includes activating a light-generating device at different distances dictated by the distance-based alert sequence.

Optionally, the feature of interest is one or more of a crossing or intersection of the route with at least one other route.

In one embodiment, a system includes a controller configured to determine whether a vehicle system moving along a route is within a designated distance of a feature of interest in or along the route. The controller is configured to initiate a distance-based alert sequence of an advisory device of the vehicle system in response to determining that the vehicle system is at or within the designated distance of the feature of interest. The controller is configured to direct the advisory device to generate advisory signals according to the distance-based alert sequence. The advisory signals are indicative of passage of the vehicle system by the feature of interest during the distance-based alert sequence. The advisory signals are generated by the advisory device at different distances of the vehicle system from the feature of interest that are dictated by the distance-based alert sequence.

Optionally, the controller directs the advisory device to generate the advisory signals as a function of the distances of the vehicle system from the feature of interest in the distance-based alert sequence.

Optionally, the controller directs the advisory device to generate the advisory signals at the different distances dictated by the distance-based alert sequence such that the advisory signals are generated at the different distances regardless of changes in speed of the vehicle system approaching the feature of interest.

Optionally, the controller directs the advisory device to generate the advisory signals at one or more first distances of the different distances dictated by the distance-based alert sequence and the controller directs the advisory device to stop generating the advisory signals at one or more second distances of the different distances dictated by the distance-based alert sequence.

Optionally, the distance-based alert sequence directs the advisory signals to be generated at the different distances as one or more designated portions of the designated distance to the feature of interest.

Optionally, the controller directs the advisory device to generate the advisory signals by activating an audible device at each of the different distances dictated by the distance-based alert sequence.

Optionally, the controller directs the advisory device to generate the advisory signals by activating a light-generating device at each of the different distances dictated by the distance-based alert sequence.

Optionally, the feature of interest is one or more of a crossing or intersection of the route with at least one other route.

In one embodiment, a system includes a location determining device configured to determine vehicle locations of a vehicle system as the vehicle system moves along one or more routes, a memory configured to store feature locations of features of interest in or along the one or more routes, an advisory device configured to generate advisory signals to notify of passage of the vehicle system through or by the features of interest, and a controller configured to monitor the vehicle locations and determine when the vehicle system is within a designated distance of one or more of the features of interests. The controller is configured to initiate a distance-based alert sequence of the advisory device of the vehicle system in response to determining that the vehicle system is at or within the designated distance of one or more of the features of interest. The advisory signals are generated by the advisory device as a spatial function of one or more of (a) distance of the vehicle system from one or more of the features of interest or (b) the locations of the vehicle system in the distance-based alert sequence.

Optionally, the controller directs the advisory device to generate the advisory signals as the spatial function such that the advisory signals are generated at a set of predefined distances from one or more of the features of interest regardless of changes in speed of the vehicle system.

Optionally, the controller directs the advisory device to generate the advisory signals by activating an audible device.

Optionally, the controller directs the advisory device to generate the advisory signals by activating a light-generating device according to the spatial function.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A method comprising:

determining whether a vehicle system moving along a route is within a designated distance of a feature of interest in or along the route;

initiating a distance-based alert sequence of an advisory device of the vehicle system in response to determining that the vehicle system is at or within the designated distance of the feature of interest; and generating advisory signals using the advisory device according to the distance-based alert sequence, the advisory signals indicative of passage of the vehicle system by the feature of interest during the distance-based alert sequence, the distance-based alert sequence dictating one or more of plural different commencement locations or commencement distances at which advisory signals are generated by the advisory device, the distance-based alert sequence also dictating one or more of plural different termination locations or termination distances where generation of the advisory signals by the advisory device is terminated.

2. The method of claim 1, wherein the advisory signals are generated and terminated as a function of distances of the vehicle system from the feature of interest in the distance-based alert sequence.

3. The method of claim 1, wherein the advisory signals are generated and terminated according to the distance-based alert sequence such that the advisory signals are generated at different distances from the feature of interest regardless of changes in speed of the vehicle system approaching the feature of interest.

4. The method of claim 1, wherein the advisory signals are generated at one or more first distances dictated by the distance-based alert sequence and the advisory signals are not generated at one or more second distances by the distance-based alert sequence.

5. The method of claim 1, wherein the distance-based alert sequence directs the advisory signals to be generated at different distances as one or more designated portions of the designated distance to the feature of interest.

6. The method of claim 1, wherein generating the advisory signals includes activating an audible device at different distances dictated by the distance-based alert sequence.

7. The method of claim 1, wherein generating the advisory signals includes activating a light-generating device at different distances dictated by the distance-based alert sequence.

8. The method of claim 1, wherein the feature of interest is one or more of a crossing or intersection of the route with at least one other route.

9. A system comprising:

a controller configured to determine whether a vehicle system moving along a route is within a designated distance of a feature of interest in or along the route, the controller configured to initiate a distance-based alert sequence of an advisory device of the vehicle system in response to determining that the vehicle system is at or within the designated distance of the feature of interest, the controller configured to direct the advisory device to generate advisory signals according to the distance-based alert sequence, the advisory signals indicative of passage of the vehicle system by the feature of interest during the distance-based alert sequence, the advisory signals generated by the advisory device at different distances of the vehicle system from the feature of interest that are dictated by the distance-based alert sequence, wherein the distance-based alert sequence directs the advisory signals to be generated at the different distances as one or more designated portions of the designated distance to the feature of interest.

10. The system of claim 9, wherein the controller directs the advisory device to generate the advisory signals as a function of the distances of the vehicle system from the feature of interest in the distance-based alert sequence.

11. The system of claim 9, wherein the controller directs the advisory device to generate the advisory signals at the different distances dictated by the distance-based alert sequence such that the advisory signals are generated at the different distances regardless of changes in speed of the vehicle system approaching the feature of interest.

12. The system of claim 9, wherein the controller directs the advisory device to generate the advisory signals at one or more first distances of the different distances dictated by the distance-based alert sequence and the controller directs the advisory device to stop generating the advisory signals at one or more second distances of the different distances dictated by the distance-based alert sequence.

13. The system of claim 9, wherein the controller directs the advisory device to generate the advisory signals by activating an audible device at each of the different distances dictated by the distance-based alert sequence.

14. The system of claim 9, wherein the controller directs the advisory device to generate the advisory signals by activating a light-generating device at each of the different distances dictated by the distance-based alert sequence.

15. The system of claim 9, wherein the feature of interest is one or more of a crossing or intersection of the route with at least one other route.

16. A system comprising:

a location determining device configured to determine vehicle locations of a vehicle system as the vehicle system moves along one or more routes;

a memory configured to store feature locations of features of interest in or along the one or more routes;

an advisory device configured to generate advisory signals to notify of passage of the vehicle system through or by the features of interest; and a controller configured to monitor the vehicle locations and determine when the vehicle system is within a designated distance of one or more of the features of interests, the controller configured to initiate a distance-based alert sequence of the advisory device of the vehicle system in response to determining that the vehicle system is at or within the designated distance of one or more of the features of interest, the advisory signals generated by the advisory device as a spatial function of one or more of (a) distance of the vehicle system from one or more of the features of interest or (b) the locations of the vehicle system in the distance-based alert sequence, wherein the controller directs the advisory device to generate the advisory signals as the spatial function such that the advisory signals are generated at a set of predefined distances from one or more of the features of interest regardless of changes in speed of the vehicle system.

17. The system of claim 16, wherein the controller directs the advisory device to generate the advisory signals by activating an audible device.

18. The system of claim 16, wherein the controller directs the advisory device to generate the advisory signals by activating a light-generating device according to the spatial function.

19. The method of claim 1, wherein the vehicle system is determined to be within the designated distance of the feature of interest by examining one or more images or videos obtained by an optical sensor.

20. The system of claim 9, wherein the controller is configured to determine that the vehicle system is within the designated distance of the feature of interest by examining one or more images or videos obtained by an optical sensor.

21. The system of claim 16, wherein the controller is configured to terminate the advisory signals according to the spatial function of the one or more of (a) the distance of the vehicle system from the one or more of the features of interest or (b) the locations of the vehicle system in the distance-based alert sequence.

* * * * *